United States Patent [19]

Sherlock

[11] 4,034,887

[45] July 12, 1977

[54] STORAGE TANK

[76] Inventor: William Raymond Sherlock, 100, Moss Lane, Sale, Cheshire, England

[21] Appl. No.: 635,047

[22] Filed: Nov. 25, 1975

[30] Foreign Application Priority Data

Nov. 29, 1974 United Kingdom ..... 51841/74

[51] Int. Cl.[2] ..... B65D 87/18

[52] U.S. Cl. ..... 220/219

[58] Field of Search ..... 220/216–227; 52/3–5, 11; 4/172.12, 172.13, 172.14

[56] References Cited

U.S. PATENT DOCUMENTS

| | | | |
|---|---|---|---|
| 2,315,023 | 3/1943 | Stevenson | 220/219 |
| 2,390,141 | 12/1945 | Wiggins | 220/219 |
| 2,482,468 | 9/1949 | Cranmer | 220/219 |
| 2,497,645 | 2/1950 | Wiggins | 220/219 |
| 2,601,316 | 6/1952 | Moyer | 220/219 |
| 2,664,220 | 12/1953 | Cord et al. | 220/219 |
| 2,789,722 | 4/1957 | Oberst | 220/219 |
| 2,844,169 | 7/1958 | Skinner | 220/219 X |
| 2,846,109 | 8/1958 | Larsen | 220/219 |
| 2,886,204 | 5/1959 | Moyer et al. | 220/219 |
| 3,474,931 | 10/1969 | Daniels et al. | 229/219 |

*Primary Examiner*—Stephen Marcus
*Attorney, Agent, or Firm*—Ross, Ross & Flavin

[57] ABSTRACT

A storage tank having a floating roof and a roof drainage system comprising a flexible conduit extending between the roof and a drain pipe adjacent the base of the tank, the lower end of the conduit being sealed relative to the drain pipe and there being a connection between the upper end of the conduit and the upper surface of the roof so that rainwater accumulating on the roof can pass down the conduit to the drain pipe, and the roof, adjacent the top of the conduit being apertured and the conduit being capable of being withdrawn therefrom and replaced without the need to empty the tank.

6 Claims, 5 Drawing Figures

STORAGE TANK

This invention relates to a storage tank, for example an oil storage tank.

It is usual for a large oil storage tank to have a floating roof, that is a roof which floats on top of the oil in the tank and seals with the sides of the tank to receive rainwater and prevent it entering the oil. A floating roof is preferred as it obviates any dead space above the contents of the tank, in which space vapour might accumulate and form an inflammable mixture. Further it prevents the evaporation of volatile constituents from the oil and escape thereof via a pressure equalisation valve which has to be provided on large tanks. Such a roof usually comprises an annular pontoon for buoyancy supporting a circular steel plate, centrally of which there is arranged a sump to collect rainwater from the roof.

Problems arise, however, in the means adopted to convey the water from the sump to waste. Because the roof rises and falls with the level of oil in the tank, such means must be capable of absorbing such movement. Previous proposals have included a flexible hose from the sump to an outlet at the base of the tank. However, the hose has tended to become damaged by vertical movement of the lid and the swirling motion of oil during emptying and filling of the tank and leakage of oil at the outlet has occurred. A further solution has been the provision of rigid pipes joined by pivotal couplings. However the couplings have also proved susceptible to leaking. Both of these solutions further entail the complete emptying of the tank before the drain can be replaced or repaired.

An object of the present invention is to provide an improved oil storage tank.

Accordingly the invention provides a storage tank having a floating roof and a roof drainage system comprising a flexible conduit extending between the roof and a drain pipe adjacent the base of the tank, the lower end of the conduit being sealed relative to the drain pipe and there being a connection between the upper end of the conduit and the upper surface of the roof so that rainwater accumulating on the roof can pass down the conduit to the drain pipe, and the roof, adjacent the top of the conduit, being apertured and the conduit being capable of being withdrawn therefrom and replaced without the need to empty the tank.

Preferably the drain pipe has a cup surrounding it and the lower end of a sleeve is so shaped that it can sealingly engage the cup.

Conveniently the conduit is longitudinally extensible and surrounds a member in the form of a pipe whose lower end meets the drain pipe and whose upper end passes through a sleeve accommodated in the aperture in the roof, openings being provided in the pipe above its junction with the lower end of the sleeve.

A sump can be provided centrally of the roof and a fixed generally horizontal pipe can lead therefrom to the sleeve. Bearing means can be arranged on top of the roof to engage the pipe above the roof to allow slight movement between the roof and pipe due to pivoting and radial movement of the roof. There can be a flexible connection between the fixed horizontal pipe and the sleeve. This also allows the sleeve and liner to be lifted up so that they can be disconnected by persons working on the roof.

The invention will be described further, by way of example, with reference to the accompanying drawings, wherein:-

FIG. 1(*b*) is a view similar to that of FIG. 1 but showing the roof in a lower position;

Figure 1B:
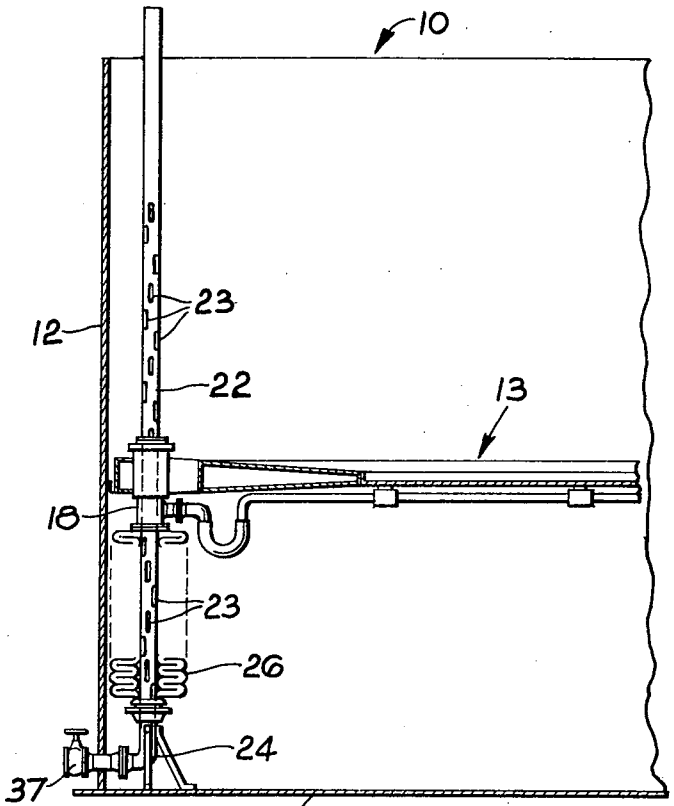
FIG. 1(*a*) is a fragmentary cross-section through a first preferred embodiment of tank of the invention, a roof thereof being in an upper position.
Figure 1A:
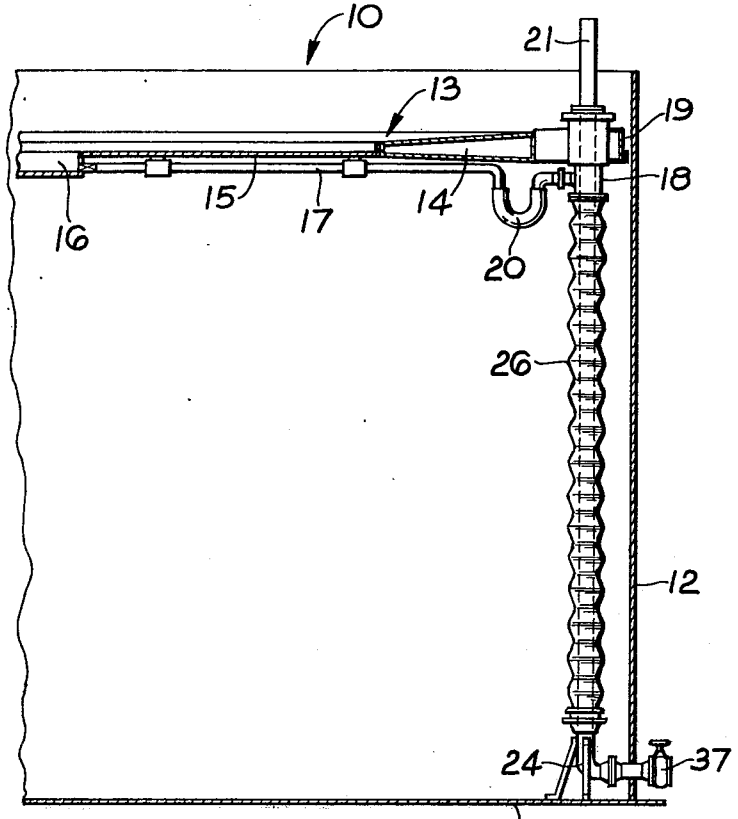

A first preferred embodiment of tank 10 conforming to the invention comprises a circular base 11, a cylindrical wall 12 and a circular floating roof 13. The roof 13 comprises an outer annular pontoon 14 supporting a steel plate 15 having a central sump 16. The outer edge of the pontoon seals with the cylindrical wall 12 of the tank 10. From the sump 16 a rigid metal pipe 17 fixed to the underside of the roof 13 extends radially outwards to a position adjacent the wall 12 of the tank 10. Here a liner 18 of glass reinforced plastics material (GRP) is disposed in an aperture 19 in the roof 13 and the metal pipe 17 connects to the liner 18 by means of a short length of flexible hose 20. A generally vertical member 21 in the form of a support pipe 22 having apertures, in the form of slots 23, spaced along its length, extends through the liner 18 and connects with a curved drain pipe 24 at its lower end. The drain pipe 24 extends out through the wall 12 of the tank 10. A cup 25 surrounds the support pipe 22 at its junction with the drain pipe 24.

Attached to the lower end of the liner 18 is the top end of an extensible flexible sleeve or gaiter 26 whose lower end sealingly engages the cup 25.

Thus, water accumulating in the sump 16 flows along the fixed horizontal pipe 17 to the liner 18 and enters the space between the gaiter 26 and the support pipe 21. Thence it can either flow to the cup 25 or enter the support pipe via the slots 23 and pass through the drain pipe 24 to waste.

Figure 2:
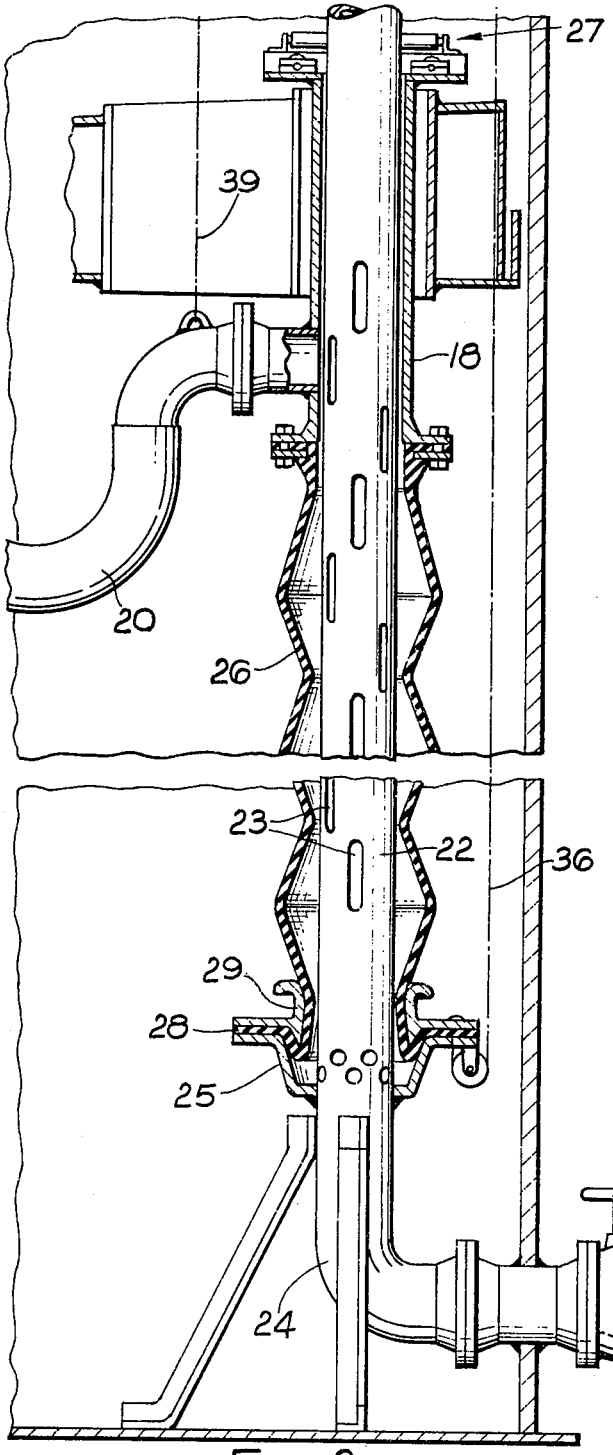
FIG. 2 is an enlarged cross-sectional view of part of FIG. 1.

The flexible connection 20 between the fixed pipe 17 and the liner 18 allows slight radial movement of the roof and also vertical movement over the height of the tank to occur without damage to the drainage system. A conventional roller arrangement 27 (FIG. 2) on the top of the roof can guide the support pipe 22 and prevent it rubbing against the roof. The liner 18 is made of GRP, for example, to eliminate the possibility of sparking which might occur at steel to steel surfaces. The lower end of the gaiter 26 has a flat annular flange 28 for sealing with the cup 25 and a weighting flange 29 of metal overlies this. To enhance the seal between the lower end of the gaiter 26 and the cup one or more tension wires or ropes (one of which is showing in dotted lines at 36 in FIG. 2) can be provided to draw the flange 28 into close engagement with the cup. Each such wire can be tensioned by a tension reel (not shown) on the roof.

Figure 4:
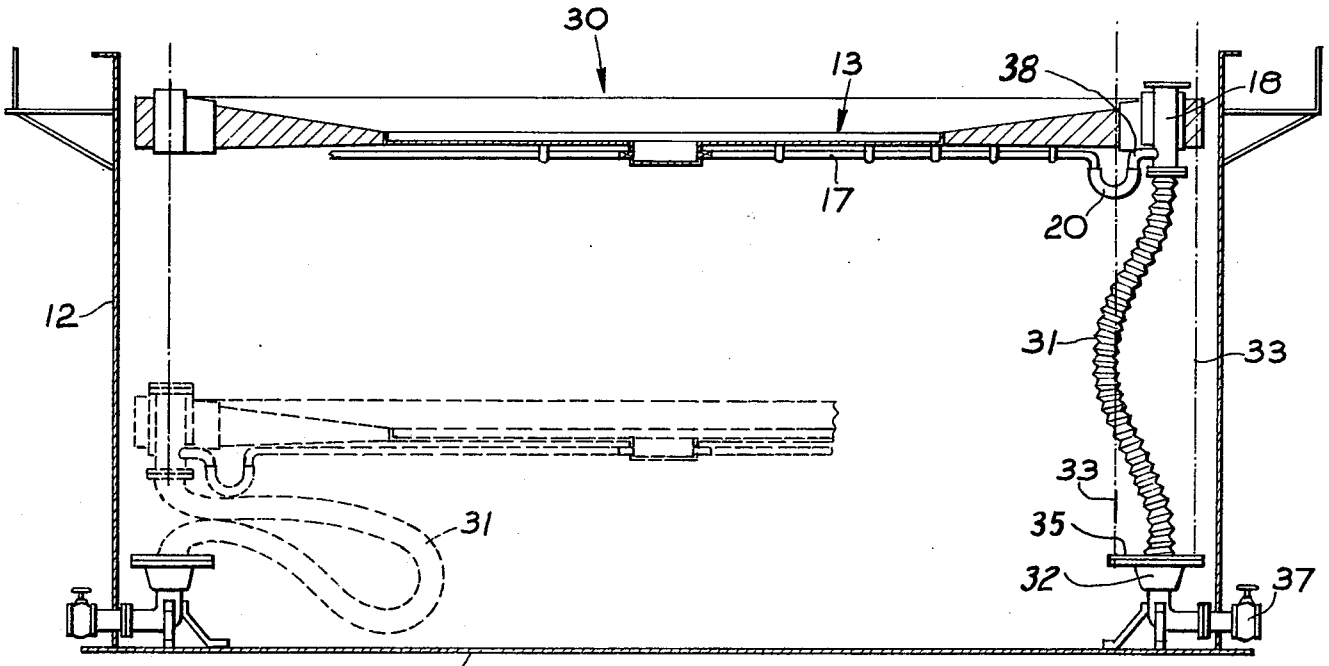
FIG. 4 is a cross-sectional view of a second preferred embodiment of tank.

A second embodiment of tank 30 conforming to the invention (FIG. 4) is similar to the tank 10. In this embodiment however the gaiter 26 is replaced by a flexible conduit 31 which seals with drain pipe 32 in the same way as gaiter 26. Guide wires or cords 33 are provided between the cup 34 and the roof and these pass through apertures in the flange assembly 35 of the conduit 31. Alternatively tension wires or cords, like cord 36 in FIG. 2, can be provided.

Both embodiments operate in similar ways when it is desired to replace the conduit, either for maintenance or because of leakage (manifesting itself by the appearance of oil in the water issuing from the drain pipe) it is not necessary to drain the tank. Firstly valve 37 on the drain pipe is closed, and the liner 18 lifted to allow access to the connection 38 between the liner and the flexible pipe 20. This connection is broken (the flexible pipe being supported, e.g. by a line 39) and the liner and conduit withdrawn from the tank via the aperture in the roof. The drain pipe and the pipe 22 (if present) fill with oil. A fresh liner and sleeve is then lowered in, guided either by the guide wires or the pipe 22, and its lower flange engaged with the cup. If tension wires are provided these can now be tightened.

When this has been done valve 37 is opened and the oil within the conduit and the drain pipe allowed to flow to storage, for example into a drum. As this happens the differential pressure of the oil in the tank urges the flange of the conduit into close sealing engagement with the cup.

Figure 3:
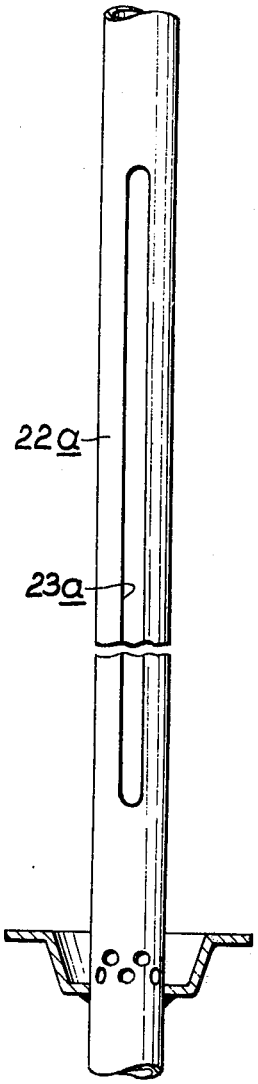
FIG. 3 illustrates an alternative construction of support pipe.

The invention is not limited to the precise details of the foregoing and variation can be made thereto. For example, the elongate member need not be a pipe as pipe 22 but can be any elongate rigid element defining, with the conduit, a fluid flow passage. Instead of a plurality of slots pipe 22a can have a continuous slot 23a as shown in FIG. 3. If an inwardly directed flange is provided at the bottom of the conduit a locking member can be provided which will engage with the drainpipe and positively clamp the conduit thereto. Such locking member could be a threaded flanged collar engagable with a complementary thread on the drainpipe, or a bayonet type assembly. The locking member would be turned by a long-shafted tool passed down the conduit. This modification is more suitable for the first embodiment as it could not easily be used with the second embodiment unless the tank was full, because of the bent conduit. However, a tool with a flexible shaft could possibly be used to overcome this difficulty.

Many other variations are possible within the scope of the following claims.

I claim:

1. In combination with a tank including a base and a side wall and an apertured floating roof having an edge in sealed relationship with the side wall and a central sump, a roof drainage system comprising:

a drain adjacent the base and extending outwardly of the tank, a generally vertically-disposed support pipe connected to the drain at its lower extremity and extending therefrom through the roof aperture at its upper extremity and having slots therethrough spaced along the length thereof, a liner disposed in circumscribing relationship with the support pipe in the area of adjacency of support pipe and roof and having an inlet leading therethrough intermediate the upper and lower terminals thereof, a first conduit disposed generally horizontally beneath the roof with an inboard terminal connecting to the sump and an outboard terminal disposed adjacent the side wall, a flexible interconnecting conduit interconnecting the outboard terminal of the first conduit and the liner inlet, and an extensible flexible sleeve circumscribing and extending along the length of the support pipe between and in sealed relationship with the drain at its lower extremity and the liner at its upper extremity.

2. The system as claimed in claim 1 wherein the sleeve is of a non-metallic material.

3. The system as claimed in claim 1 wherein the liner and sleeve are connected by flanges.

4. The system as claimed in claim 1 wherein the flexible interconnecting conduit allows the liner to be withdrawn sufficiently far from the roof for its connection to the sleeve to be broken for withdrawing the sleeve.

5. The system as claimed in claim 1, wherein the sleeve is longitudinally expansible defining a flow channel with the support pipe from top to bottom of the sleeve.

6. The system as claimed in claim 1, wherein a cup surrounds the drain pipe for sealingly engaging with the sleeve.

* * * * *